US005718491A

United States Patent [19]

Li

[11] Patent Number: 5,718,491

[45] Date of Patent: Feb. 17, 1998

[54] SUPPORTING BRACKET/BOX

[76] Inventor: Chin-Chu Li, No. 1-4, Wu Nan Rd., Wu Chi Chen, Taichung Hsien, Taiwan

[21] Appl. No.: 761,615

[22] Filed: Dec. 6, 1996

[51] Int. Cl.[6] ..... A47B 77/00

[52] U.S. Cl. ..... 312/107; 312/108; 312/111

[58] Field of Search ..... 312/107, 108, 312/111, 198; 403/340, 339, 361

[56] References Cited

U.S. PATENT DOCUMENTS

| | | | |
|---|---|---|---|
| 3,653,734 | 4/1972 | Ungaro | 312/198 X |
| 5,016,946 | 5/1991 | Reznikov et al. | 312/108 |
| 5,027,961 | 7/1991 | Howitt | 312/108 X |

FOREIGN PATENT DOCUMENTS

| | | | |
|---|---|---|---|
| 239917 | 3/1946 | France | 312/107 |
| 1045527 | 11/1953 | France | 312/107 |
| 1301054 | 7/1962 | France | 312/107 |
| 2422363 | 12/1979 | France | 312/111 |
| 538793 | 11/1931 | Germany | 312/107 |
| 2244654 | 3/1973 | Germany | 312/107 |
| 2421969 | 12/1974 | Germany | 312/111 |
| 257083 | 3/1949 | Switzerland | 312/107 |
| 428127 | 7/1967 | Switzerland | 312/108 |

*Primary Examiner*—Peter M. Cuomo
*Assistant Examiner*—Hanh V. Tran
*Attorney, Agent, or Firm*—Morton J. Rosenberg; David I. Klein; Jun Y. Lee

[57] ABSTRACT

A supporting box is provided which includes a unit box having at least one or a pair of drawers. In a face-to-face assembly, a first unit box can be joined with a second unit box by the engagement between a plurality of projecting ribs and projected grooves of a partitioning plate and opposing side plates of the first unit box and a plurality of corresponding projected grooves and projecting ribs of the second unit box. In a face-to-back assembly, a first unit box can be joined with a second unit box by the engagement between a plurality of projecting ribs and projected grooves of the first unit box and a plurality of corresponding recessed grooves of the second unit box. The supporting box can be readily configured with any number of unit boxes to meet different requirements.

2 Claims, 5 Drawing Sheets

SUPPORTING BRACKET/BOX

BACKGROUND OF THE INVENTION

1. Field of the Invention

The present invention relates to a supporting bracket/box. More particularly, the present invention is directed to a versatile supporting bracket/box which can be readily assembled and adapted to meet different requirements, such as supporting a fax machine or a printer of different sizes.

2. Prior Art

A conventional supporting bracket for a printer or a fax machine provides a simple supporting function wherein the fax machine or printer are disposed thereon. Some brackets may be provided with a drawer to store paper or documents. Nevertheless, the existing or conventional supporting bracket is made with a fixed configuration and size, it cannot be adapted or modified to accommodate different requirements. For example, when a new and larger printer or fax machine is installed, the original supporting bracket is rendered useless and is wasted. Furthermore, the user must purchase a new supporting bracket, even though the original one is still useful. Accordingly, there is a need to provide a new supporting bracket/box which can be readily assembled and adapted for different applications.

SUMMARY OF THE INVENTION

It is the object of this invention to provide a supporting bracket/box which can be readily assembled and adapted for different applications and for different desktop facilities.

In order to achieve the object set forth, the supporting bracket/box made according to this invention generally comprises a unit box having a pair of drawers disposed therein. A first unit box can be joined with a second unit box by engagement between a plurality of projecting ribs and projected grooves of a first unit box and a plurality of corresponding projected grooves and projecting ribs of a second unit box. Accordingly, at least two unit boxes can be joined together.

In an alternative embodiment of the present invention, a first partitioning plate, a first projected rib and a first projected groove of a side plate of the first unit box can be engaged with a second recessed groove of a second unit box, to configure a supporting bracket/box.

The number of unit boxes to be joined can be readily increased and decreased to meet the actual requirements. Consequently, a plurality of supporting bracket/boxes can be assembled to support a fax machine or a printer of different sizes.

BRIEF DESCRIPTION OF THE DRAWINGS

In order that the present invention may more readily be understood the following description is given, merely by way of example, with reference to the accompanying drawings, in which.

BRIEF DESCRIPTION OF NUMERALS

Figure 1:
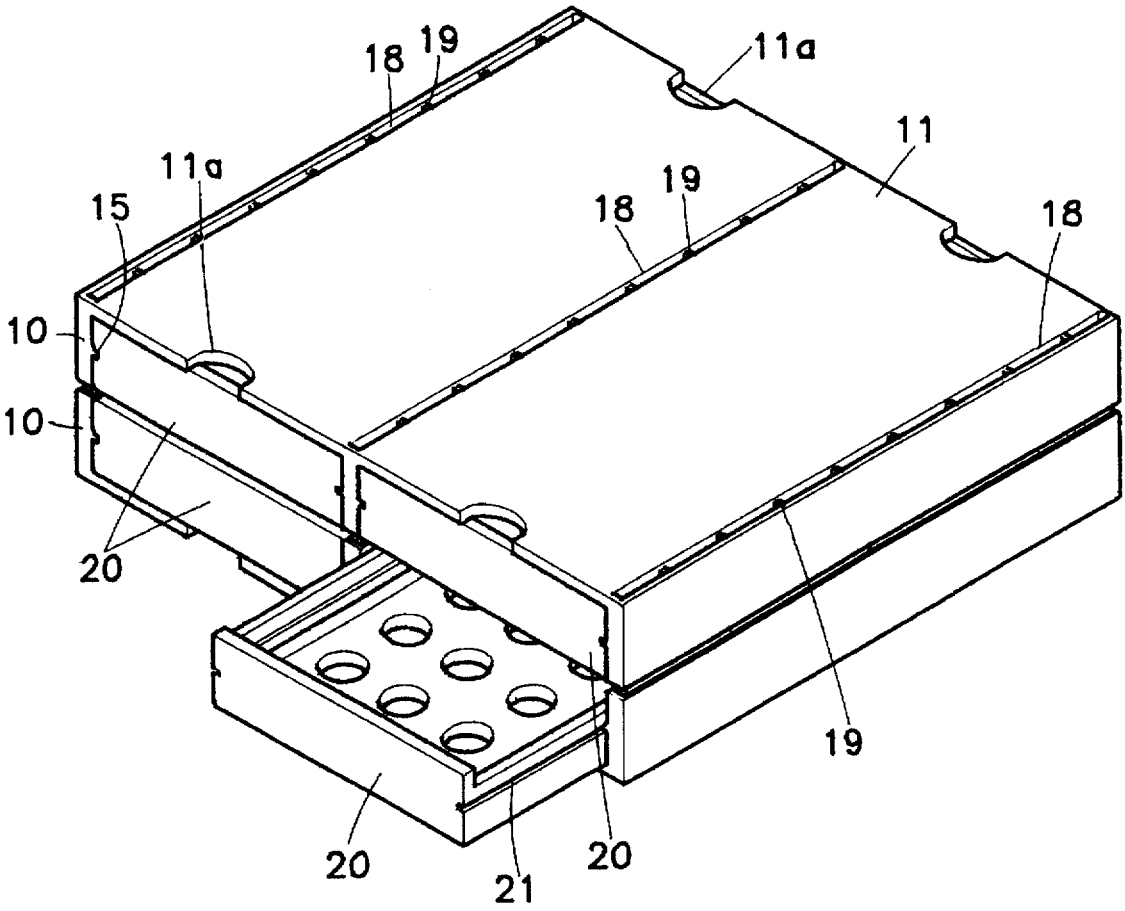
FIG. 1 is a perspective view showing a supporting bracket/box of the present invention.

10 bracket/box
11 top plate
**11*a*** cutout
12 partitioning plate
13 side plate
14 guiding rail
15 guiding rail
16 projecting rib
17 projected groove
18 recessed groove
19 retaining tab
20 drawer
21 sliding groove

DETAILED DESCRIPTION OF PREFERRED EMBODIMENTS

Figure 2:
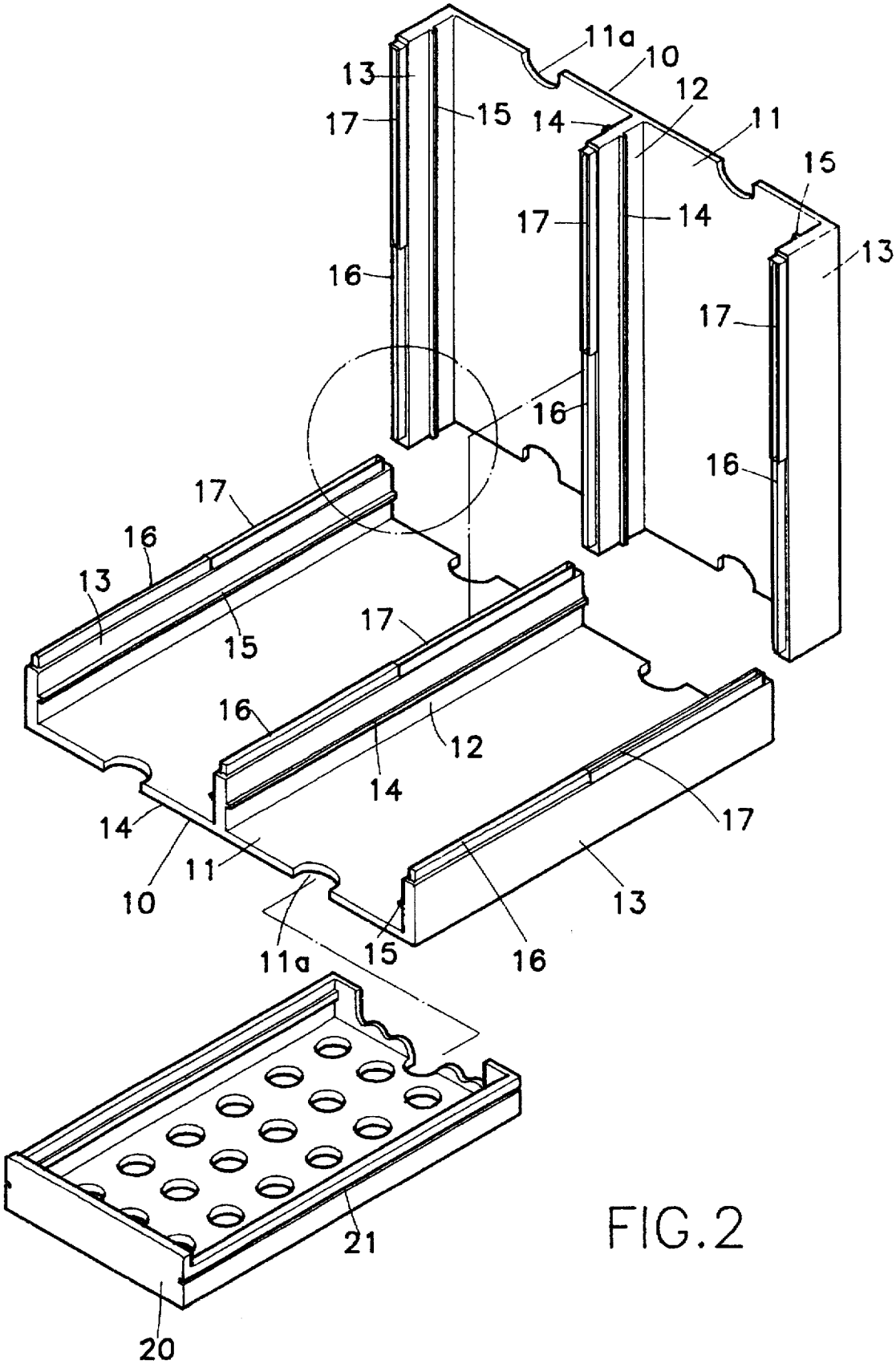
FIG. 2 is an exploded perspective view of the supporting bracket shown in FIG. 1.

Referring to FIGS. 1 and 2, a supporting bracket/box is shown and comprises a unit box 10 having at least one drawer 20. The unit box 10 includes a top plate 11 having a partitioning plate 12 extending downwardly from the bottom of the top plate 11. A side plate 13 also extends from both ends of the top plate 11, such that the partitioning plate 12 and the side plates 13 have the same height. Accordingly, the unit box 10 is defined by the top plate 11, partitioning plate 12, and side plates 13, wherein there are two drawer compartments and the front, rear and bottom sides are open. The front portion of the top plate 11 is provided with a cutout **11*a* to provide an access to the drawer 20. Consequently, the drawer 20 can be readily drawn out by the access provided by the cutout 11*a***.

Figure 3:
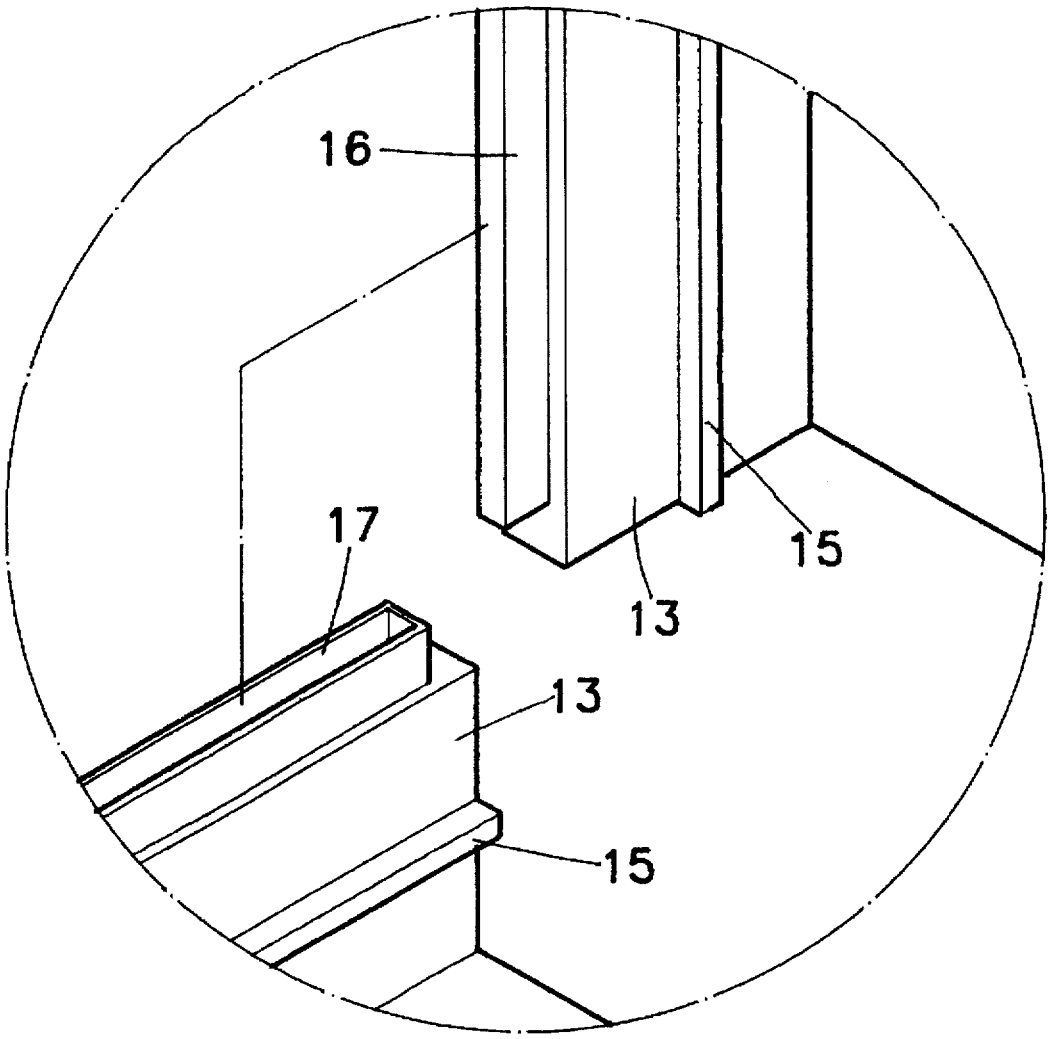
FIG. 3 is an enlarged view of the supporting bracket/box encircled in FIG. 2.

Both sides of the partitioning plate 12 are provided with a guide rail 14 and the inner side of each side plate 13 is also provided with a guide rail 15 corresponding to the guide rail 14. The end portions of the partitioning plate 12 and each of the side plates 13 are provided with a projecting rib 16 and a projected groove 17, as shown in the enlarged view of FIG. 3. The central and side portions of the outer surface of the top plate 11 are provided with recessed grooves 18 disposed in correspondence with the projecting rib 16 and projected groove 17 of the partitioning plate 12 and side plates 13. Extending from one inner side wall of the recessed groove 18, there is provided a plurality of retaining tabs 19. The retaining tabs 19 are spaced from a respective side wall by a preset distance to facilitate engagement with the projecting rib 16 and projected groove 17 of a second unit box 10.

The drawer 20 is a container without the upper ceiling. Both sides of the drawer 20 have a sliding groove 21 disposed in correspondence with guide rails 14, 15 of the partitioning plate 12 and a respective side plate 13. Accordingly, the drawer 20 is slidably received within the drawer compartment by the sliding engagement between the sliding groove 21 and the guide rails 14, 15 of the partitioning plate 12 and the side plate 13. In this embodiment, there are two drawers 20 that are received within the unit box 10.

As shown in FIGS. 1 and 2, a first unit box 10 together with its two drawers 20 can be engaged with a second unit 10 having two drawers 20, by the interference engagement between a plurality of projecting ribs 16 and projected grooves 17 of the partitioning plate 12 and side plates 13 with a plurality of correspondingly projected grooves 17 and projecting ribs 16 of the partitioning plate 12 and side plates 13 of a second unit box 10. Consequently, two stories or even more than three stories of supporting bracket/boxes can be configured. The top surface of the supporting bracket/box can be used to support a fax machine or a printer. On the other hand, the drawers 20 can be used for storing booklets, paper or other stationery. Alternatively, the drawers 20 can be removed to hold paper sheets or documents directly. That arrangement can be referred to as a face-to-face assembly.

Figure 4:
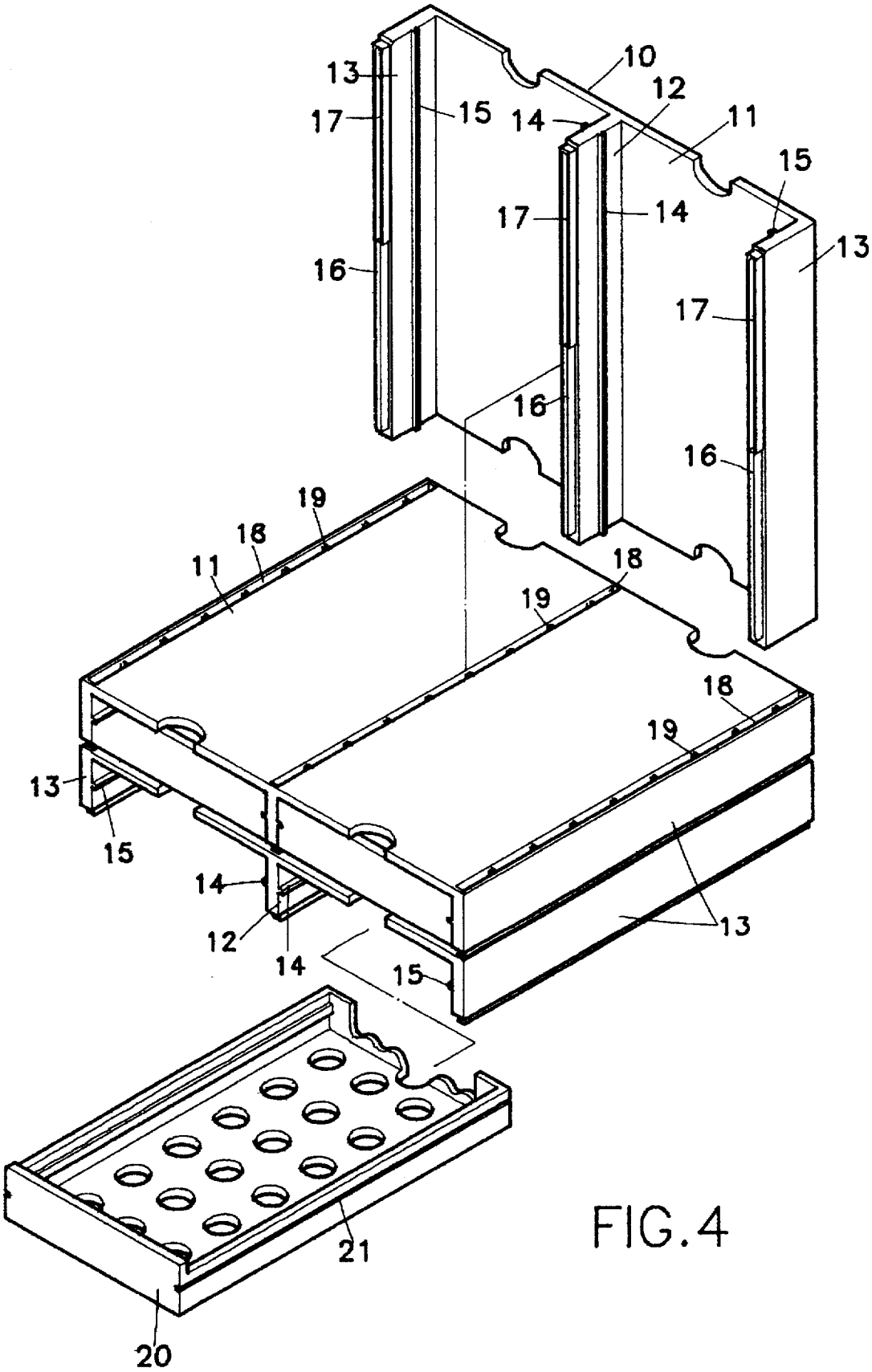
FIG. 4 is a schematic illustration of the supporting bracket/box made according to the present invention.

A plurality of the unit boxes 10 made according to this invention can be readily assembled to meet different requirements. As shown in FIG. 4, a first unit box 10 together with its two drawers 20 can be engaged with a second unit 10 having two drawers 20 by the interference engagement between the first projecting rib 16 and projected groove 17 of the partitioning plate 12 and side plates 13 with recessed grooves 18 of a second unit box 10, wherein the side walls of the first projecting rib 16 and projected groove 17 are firmly retained by the retaining tabs 19 disposed within the recessed groove 18. This second arrangement can be referred to as a face-to-back assembly and more than two stories of unit boxes 10 can be assembled to configure a supporting bracket/box for a fax machine and/or a printer. By this second arrangement, no matter what the size of the fax machine or printer is, a matched supporting bracket/box can be readily adapted to meet its requirements.

Figure 5:
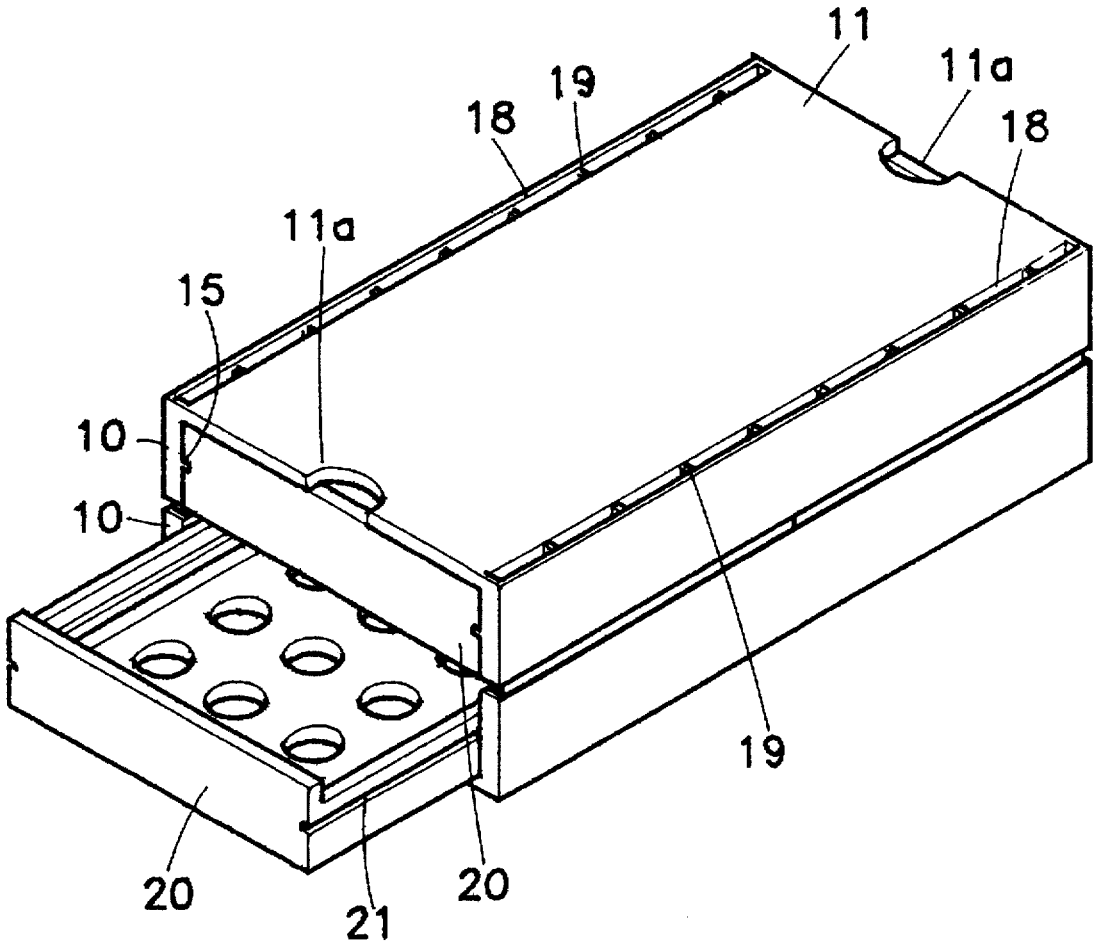
FIG. 5 is a perspective view showing an alternative embodiment of the supporting bracket/box made according to the present invention.

FIG. 5 discloses another alternative, wherein the partitioning plate 12 can be eliminated to configure a unit box 10 with only a single drawer 20.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A supporting box assembly, comprising:

a plurality of unit boxes stackably coupled together, each of said plurality of unit boxes including a top plate having a central partitioning plate extending downwardly from a bottom surface of said top plate to an end portion thereof, a pair of side plates each extending from an opposing side portion of said top plate to an end portion thereof such that said partitioning plate and said pair of side plates have a substantially equivalent height and define open channels therebetween, opposing sides of said partitioning plate each being provided with a guide rail and an inner side of each of said side plates being provided with a guide rail corresponding to a respective one of said guide rails of said partitioning plate, said end portions of said partitioning plate and said side plates each having a projecting rib and a projected groove, said projecting rib being dimensioned to be insertably received within a respective projected groove of another of said plurality of unit boxes and said projected groove being dimensioned to insertably receive therein a respective projecting rib of said other unit box, said top plate having a plurality of recessed grooves respectively formed in a central and opposing side portions of a top surface thereof, each of said plurality of recessed grooves being disposed in correspondence with a respective projecting rib and projected groove, said top plate having a plurality of retaining tabs formed in each of said plurality of recessed grooves, each of said plurality of retaining tabs extending from one side wall of a respective recessed groove and being spaced from an opposing wall thereof for providing an interference fit with a respective projecting rib and projected groove of another of said plurality of unit boxes;

at least one drawer being slidably received within one of said plurality of unit boxes and having a sliding groove formed in each of opposing sides thereof in correspondence to a respective guide rail of said partitioning plate and a guide rail of a respective one of said side plates, wherein a first alternative assembly configuration is formed by respective coupling of said projecting ribs and projected grooves of a first of said plurality of unit boxes with said projected grooves and said projecting ribs of a second of said plurality of unit boxes, and wherein a second alternative assembly is formed by coupling of said projecting ribs and projected grooves of said second unit box with said respective recessed grooves of said first unit box.

2. The supporting box assembly as recited in claim 1 wherein a third of said plurality of unit boxes is secured to said second unit box by coupling of said projecting ribs and projected grooves of said third unit box with said respective recessed grooves of said second unit box.

* * * * *